US006363665B1

(12) United States Patent
Soehn

(10) Patent No.: US 6,363,665 B1
(45) Date of Patent: Apr. 2, 2002

(54) MODULAR COMPONENT SHELTER

(75) Inventor: Peter Soehn, Kelowna (CA)

(73) Assignee: Larry A. Lalonde, Kelowna (CA)

( * ) Notice: Subject to any disclaimer, the term of this patent is extended or adjusted under 35 U.S.C. 154(b) by 0 days.

(21) Appl. No.: 09/527,255

(22) Filed: Mar. 17, 2000

(51) Int. Cl.[7] ..... E04B 7/08

(52) U.S. Cl. ..... 52/81.2; 52/80.1; 52/783.14; 52/782.1; 52/783.11; 52/79.4; 52/460; 52/82; 52/236.2; 52/464; 52/81.1

(58) Field of Search ..... 52/80.1, 783.14, 52/782.1, 783.11, 81.2, 79.4, 460, 82, 236.2, 464, 81.1

(56) References Cited

U.S. PATENT DOCUMENTS 3,482,367 A * 12/1969 Curran ..... 52/80.1
3,546,826 A * 12/1970 Chapman ..... 52/80.1
4,068,421 A 1/1978 Marovich ..... 52/80
4,409,771 A * 10/1983 Lowe ..... 52/80.1
5,513,471 A 5/1996 Worms et al. ..... 52/82
5,916,097 A * 6/1999 Markuten ..... 52/80.1

FOREIGN PATENT DOCUMENTS

CA 2103103 12/1997 ..... E04H/1/12

* cited by examiner

*Primary Examiner*—Carl D. Friedman
*Assistant Examiner*—Chi Nguyen
(74) *Attorney, Agent, or Firm*—Antony C. Edwards

(57) ABSTRACT

A modular component shelter includes an adjacent side-by-side array of curved, interlocking, rigid panels. The panels curve upwardly and inwardly to a common vertex from a common base-level circumferential rim. The panels interlock between adjacent panels by means of raised interlocking ribs. The ribs extending in generally vertical planes along opposite side edges of each panel so as to form a first channel along a first side edge of each panel and second channel along an opposite second side edge of each panel. The first channel is shaped to snugly fit within the second channel along the length thereof. The first channel is releasably securable in the second channel.

9 Claims, 4 Drawing Sheets

ROOF PLAN 795 sqft. (73.86m2)

SIDE ELEVATION

END ELEVATION

MODEL C-435

15 COMPONENT

20' x 26'

MODULAR COMPONENT SHELTER

FIELD OF THE INVENTION

This invention relates to the field of habitable shelters constructed from a plurality of light weight, insulated and rigid interlocking modular components. In particular, it relates to shelter components which are curved along the longitudinal axis to provide a substantially vertical wall portion and an upward and inwardly sloping roof portion which terminates at a common vertex. The components, or panels, by virtue of having an integrally formed channel adjacent each longitudinal edge may be efficiently interlocked and assembled in a side-by-side array to form a habitable shelter.

BACKGROUND OF THE INVENTION

As a basis for satisfying the housing needs for the less fortunate in North America and in other countries, traditional residential construction based upon the current wood based methodology is impractical due to the cost of materials, the level of skill required of the labour force, and the length of time required to construct such residences. In addition such construction is impractical under many climate conditions.

Further, where the people in a locality have been deprived of their homes through the forces of a natural disaster or of political turmoil, or where exploration and development is undertaken in remote areas, shelters for use as dwellings, hospitals or storage areas are usually a priority.

When such shelters are required, the lack of available construction time, materials or expertise at the scene renders on site construction by traditional methods impracticable.

Presently, portable shelters which are available for transportation to such a site have several shortcomings such as their weight, their complex method of erection and assembly and that they generally provide only minimal protection from adverse temperatures, heavy rains or strong gusts of wind.

In the prior art within this field, the applicant is aware of U.S. Pat. No. 5,513,471 and Canadian Patent No. 2,103,103 which are corresponding patents issued to the same inventor and describe a contiguous wall panel section which is formed in three planar portions; namely a vertical lower portion, a relatively gently inwardly sloping intermediate portion and a more aggressive inwardly sloping upper portion. The wall panels are formed with parallel longitudinal sides, each of which has an integrally formed rib or channel and into which the channel of the corresponding side rib of successive wall panels are nested and secured.

Corner panels are formed in the same way as the wall panels except that the vertical lower portion is curved in a horizontal plane. Two corner panels are utilized at a comer. The longitudinal sides of the lower section are parallel, while the outer sides of the intermediate and the upper section sections of adjacent comer panels converge toward the top of the panel to match adjacent side wall panels. Separate panels provide a roof enclosure.

The applicant is also aware of U.S. Pat. No. 4,068,421, in which is revealed an integrally formed, smoothly curved wall panel which is formed as a hemi-spheroidal section. The longitudinal edges of each panel has a channel which can be interfitted with the channel on adjacent panels which are then bolted together. Intermediate or wall panels having parallel longitudinal sides can be used to enlarge the structure to a generally ellipsoidal shape. Separate upper panels provide a roof enclosure.

SUMMARY OF THE INVENTION

It is the object of the present invention to provide a habitable shelter constructed from separate interlocking components or panels. The panels can be fabricated from a rigid, light weight material such as Fiberglas or the like material, suitably treated to resist degradation when exposed to ultra violet radiation, and embody both end wall and side wall panels. The end wall panels are spherical triangular segments having an exterior horizontal arc equal to 45 degrees. Side wall panels, having generally parallel longitudinal edges, may also be provided which can be utilized to lengthen and widen the shelter. The panels may typically contain thermal insulation and selective panels may be provided with integral windows and entry doors.

Thus the present invention provides a sturdy weather proof shelter suitable for habitation which is assembled from pre-made modular components. The components take the form of wall panels which are curved inwardly and upwardly from a common base-level rim to a common vertex. The vertex is generally enclosed by a roof cap which provides a weatherproof cover. Each panel can be securely interlocked to the adjacent panel by means of raised channels which extend along the length of the panel in generally vertical planes adjacent and parallel to the longitudinal side edges of the panel.

A first channel is formed adjacent a first longitudinal side edge of the panel and a second channel is formed adjacent a second longitudinal side edge of the panel. First channels of each panel are formed so as to snugly fit within the second channels formed adjacent the second longitudinal side edge of panels when positioned in a side-by-side array. The channels are secured in an interlocked relationship by means of releasable fasteners such as bolts or the like.

Lateral displacement of the side-by-side array of panels is further inhibited by the formation of a first channel step formed along a first side of the first channel and a first channel lip formed on a second side of the first channel. The first channel lip protrudes laterally outwardly from the first channel. A corresponding second channel lip protrudes laterally outwardly from the first side of the second channel, and a raised auxiliary rib is formed parallel to and spaced from the opposite second edge of the second channel.

During assembly of these shelter components, the first longitudinal side edge of a panel is placed over a second side edge of an adjacent panel in the side-by-side array so that the second channel is securely nested within the overlying first channel. Such positioning ensures that the second channel lip, adjacent the second channel, is placed in engagement beneath the first channel step, adjacent the first channel, and the first channel lip is snugly fitted between the second channel and the raised auxiliary rib. Releasable fasteners such as bolts can then be placed through aligned holes in the ribs.

In summary, the modular component shelter of the present invention includes an adjacent side-by-side array of curved, interlocking, rigid panels. The panels curve upwardly and inwardly to a common vertex from a common base-level circumferential rim. The panels interlock between adjacent panels by means of raised interlocking ribs. The ribs extend in generally vertical planes along opposite side edges of each panel so as to form a first channel along a first side edge of each panel and second channel along an opposite second side edge of each panel. The first channel is shaped to snugly fit within the second channel along the length of the channels. The first channel is releasably securable in the second channel by means of releasable fasteners such as bolts.

In the modular shelter of the present invention the panels include at least one curved array of end panels, the array of end panels in adjacent side-by-side array forming a rounded first end cap of the shelter. The end cap is formed as a generally spherical triangle. The modular shelter further includes a second end cap, identical to the first end cap, the first and second end caps in opposed facing relation.

For a smaller modular shelter the first and second end caps are mounted to each other. For a larger modular shelter intermediate panels are mounted in parallel array in the adjacent side-by-side array between the first and second end caps so as to form an elongate shelter.

In the modular shelter of the present invention the first channel further includes a step formed along a first edge of the first channel and a first channel lip formed along, so as to protrude outwardly of, an opposite second edge of the first channel. The second channel further includes a second channel lip formed along, so as to protrude outwardly of, a first edge of the second channel. A raised auxiliary rib is parallel to and spaced from an opposite second edge of the second channel. When the second channel of one of the panels is interlocked within the first channel of an adjacent panel in the adjacent side-by-side array, by snug fitment of the first channel over the second channel, the second channel lip mates snugly under the step and the first channel lip fits snugly between the second edge of the second channel and the auxiliary rib. A roof cap may be mounted over the common vertex. One of the intermediate panels may have a door portal formed therein.

DETAILED DESCRIPTION OF PREFERRED EMBODIMENTS

Figure 1A:
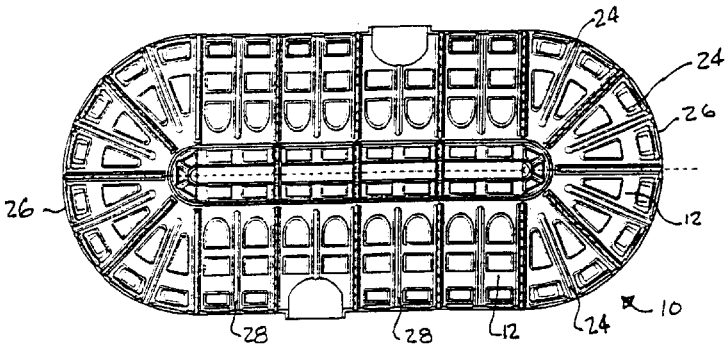
FIG. 1*a*, is a plan view of an embodiment of the modular component shelter.

The modular component shelter 10 of the present invention consists of a plurality of light weight, insulated and rigid interlocking panels 12. Modular interlocking panels 12 are curved along the longitudinal axis A from a common base-level rim 12*a* to provide a substantially vertical wall portion 12*b* and an upward and inwardly sloping roof portion 12*c*. Roof portion 12*c* terminates at a common vertex 14. A roof cap 16 is secured to panels 12 adjacent common vertex 14 to provided a weather seal. Panels 12 may be provided with windows 18 and a door portal 20.

Figure 1B:
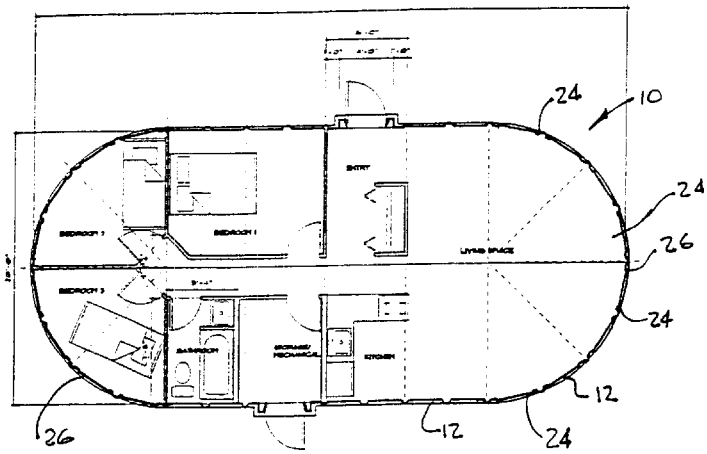
FIG. 1*b* is a horizontal sectional view of the modular component shelter of FIG. 1.
Figure 1C:
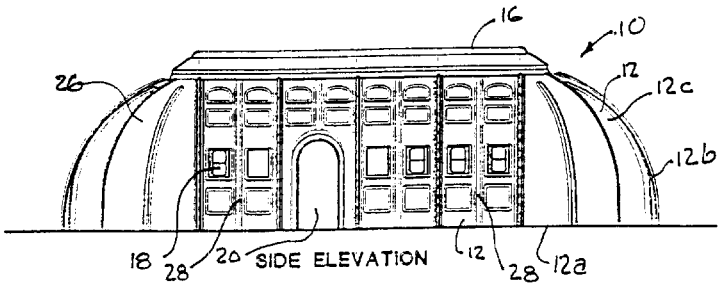
FIG. 1*c* is a side elevational view of the modular component shelter of FIG. 1.
Figure 1D:
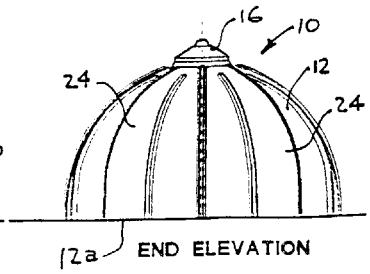
FIG. 1*d* is an end elevational view of the modular component shelter of FIG. 1.
Figure 1E:
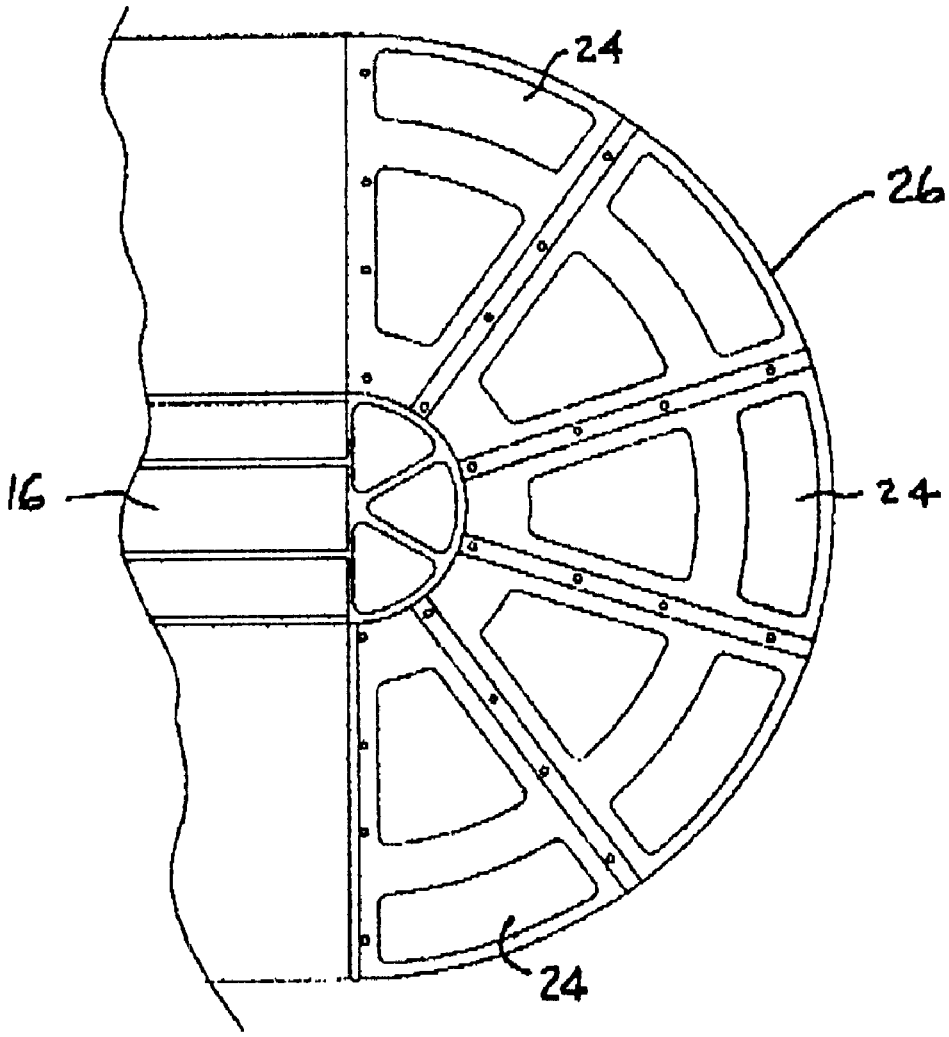
FIG. 1*e* is a plan view of the rounded end portion of the modular component shelter.
Figure 2:
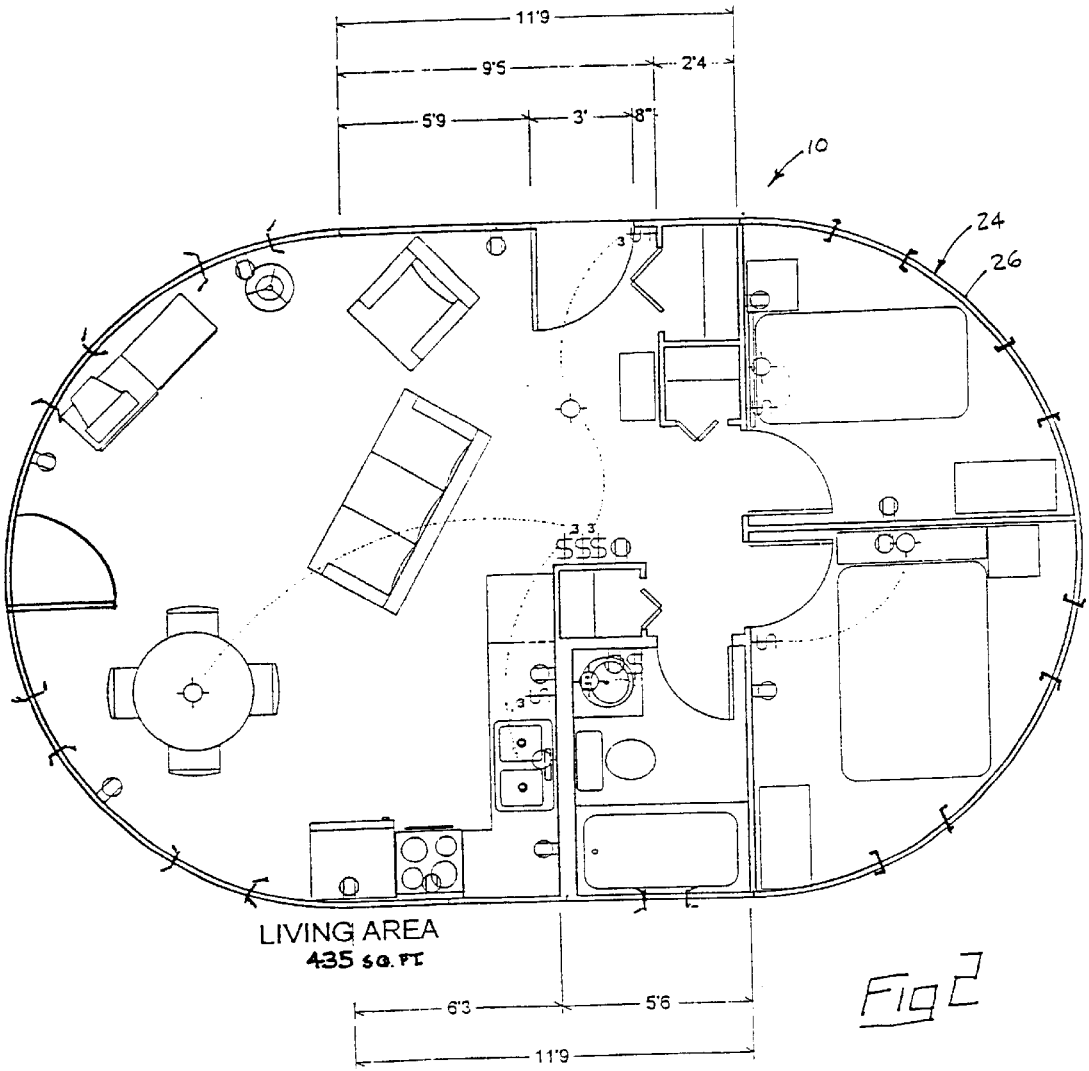
FIG. 2 is a horizontal sectional view of an alternative embodiment of the modular component shelter.
Figure 3:
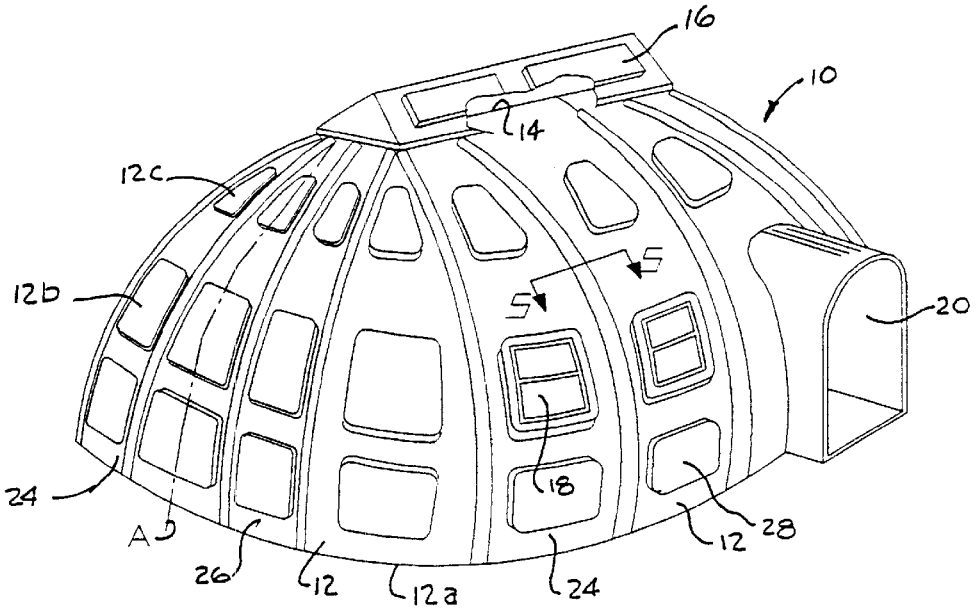
FIG. 3 is a perspective view of the modular component shelter.

End panels 24 are arcuately formed in a horizontal plane adjacent the base-level rim 12*a,* so that a side-by side array of panels 24 will create a rounded end portion 26 of shelter 10. End panels 24 are generally spherically triangular in shape as noted in FIGS. 1*a* and 1*b* and have side edges which converge toward the apex. A plurality of end panels 24 secured in a side-by-side array will form the rounded end portion 26 for shelter 10 which generally encompasses a horizontal arc 180 degrees. In the form illustrated, five such end panels, each having an angle of 36 degrees included between the longitudinal sides are required, however an included angle of greater or lesser extent may be designed. In a preferred embodiment, as illustrated in FIG. 1*e,* the rounded end portion 26 of shelter 10 comprises five end panels 24 each of which encompasses a horizontal arc of 36 degrees between its longitudinal sides. In its most simplest form the shelter could be made from a side-by-side array of such end panels so as to create a compact hemispherically shaped shelter.

Generally, however, such a compact hemispherically shaped shelter is unsuitable as habitation for more than a short duration. More comfortable and larger shelters are simply and quickly created by the addition of side wall panels 28. Side wall panels 28 are also arcuate along the longitudinal axis similar to end panels 24 and have opposed side edges which are parallel.

Figure 4:
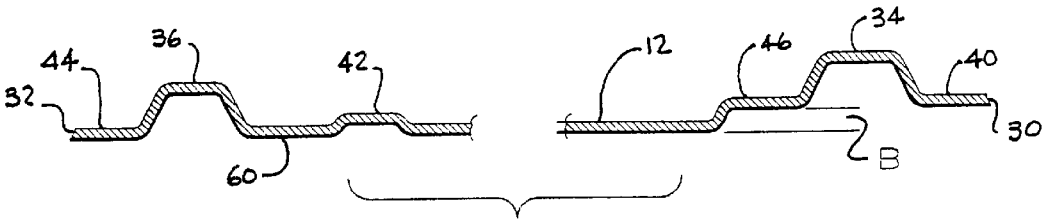
FIG. 4 is a horizontal sectional view through a typical panel.
Figure 5:
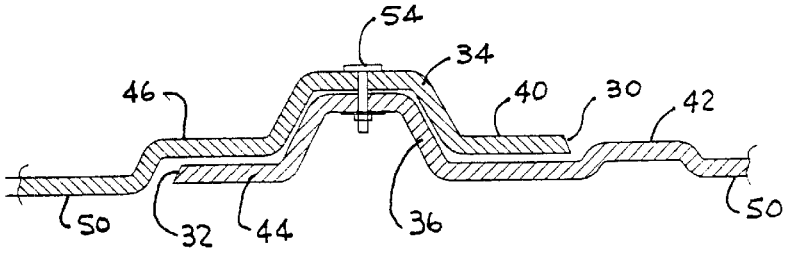
FIG. 5 is an enlarged sectional view along line 5—5 of FIG. 3.

As may be viewed in FIGS. 4 and 5 the panels have first and second longitudinal side edges 30 and 32 respectively. A first channel 34 is formed adjacent to first longitudinal side edge 30 of the panel and a second channel 36 is formed adjacent to second longitudinal side edge 32 of the panel. First channel 34 is slightly larger than channel 36 so that when first longitudinal side edge 30 overlaps second longitudinal side edge 32, in a vertical side-by-side array of panels, second channel 36 will fit snugly within first channel 34.

Projecting laterally outward from first channel 34 is a first channel lip 40. Formed parallel to and spaced inwardly from first channel 34 is a first channel step 46. A second channel lip 44 protrudes laterally outwardly from second channel 36. Positioned inwardly and parallel to second channel 36 is a raised auxiliary rib 42. Both first channel step 46 and raised auxiliary rib 42 are spaced inwardly from their respective channels by a distance equal or slightly greater than the lateral width of the channel lips 40 and 44 respectively, i.e. the lateral distance that raised auxiliary rib 42 is spaced laterally inwardly from channel 36 matches the lateral width of first channel lip 40 while the lateral distance that first channel step 46 extends laterally inwardly from first channel 34 matches the lateral width of second channel lip 44. This feature provides a positive positioning device which ensures proper interlocking of the panel edges. The contact between the panel edges and the adjacent shoulders created by the raised auxiliary rib 42 and channel step 46 prohibits lateral dislocation between the nested edges. Releasable fasteners such as bolts 54 can then be placed through aligned holes in the ribs to secure the panels together.

With reference to both FIGS. 4 and 5 it will be noted that second channel lip 44, and step 46 are offset from the body 38 of the panel by a distance 'B' which is generally equal to the thickness of the panel. Such offset distance 'B' permits the inside face 50 of adjacent panels to be kept in planar alignment when the second longitudinal side edge 32 of the panel is overlapped by first longitudinal side edge 30 of an adjacent panel when positioned in an overlapping side-by-side array.

The exterior surface of the panels may be a rigid material such as Fiberglas or the like. The inner surface of the panel may have a layer 60 of insulative material. Alternatively the insulative material may be thermal mass product such has been developed by Phase Change Laboratories of San Diego Calif., which is suitable for either application to the interior surface of the panel or to be blended into the material from which the panel is manufactured.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A modular component shelter comprising:

an adjacent side-by-side array of curved, interlocking, separate rigid panels forming a wall, said panels curving upwardly and inwardly to a common vertex from a common base-level circumferential rim, said panels interlocking between adjacent panels by means of raised interlocking ribs, said ribs extending in generally vertical planes along opposite side edges of each panel so as to form a first channel along a first side edge of each panel and second channel along an opposite second side edge of each panel, said first channel shaped to snugly fit within said second channel along the length thereof and releasably securable therein by means of releasable fasteners, wherein said first channel further comprises a step formed along a first edge of said first channel, and a first channel lip formed along, so as to protrude outwardly of, an opposite second edge of said first channel, and wherein said second channel further comprises a second channel lip formed along, so as to protrude outwardly of, a first edge of said second channel, and a raised auxiliary rib parallel to and spaced from an opposite second edge of said second channel, wherein when said second channel of one of said panels is interlocked within said first channel of an adjacent panel in said adjacent side-by-side array, by snug fitment of said first channel over said second channel, said second channel lip mates snugly under said step and said first channel lip fits snugly between said second edge of said second channel and said auxiliary rib.

2. The modular shelter of claim 1 wherein said panels comprise at least one curved array of end panels, said array of end panels in said adjacent side-by-side array forming a rounded first end of said shelter.

3. The modular shelter of claim 2 wherein said end cap is formed as a generally spherical triangle.

4. The modular shelter of claim 2 further comprising a second end cap, identical to said first end, said first and second end caps in opposed facing relation.

5. The modular shelter of claim 4 wherein said first and second end caps are each formed as spherical triangles.

6. The modular shelter of claim 4 wherein said first and second end caps are mounted to each other.

7. The modular shelter of claim 4 wherein intermediate panels are mounted in parallel array in said adjacent side-by-side array between said first and second end caps so as to form an elongate shelter.

8. The modular shelter of claim 1 further comprising a roof cap mounted over said common vertex.

9. The modular shelter of claim 7 wherein one of said intermediate panels has a door portal formed therein.

* * * * *